US008910496B2

(12) United States Patent
Monahan

(10) Patent No.: US 8,910,496 B2
(45) Date of Patent: Dec. 16, 2014

(54) INTERCHANGEABLE EARRING AND NECKLACE KITS AND METHODS FOR THEIR STORAGE AND USE

(75) Inventor: Lisa J. Monahan, Newton Highlands, MA (US)

(73) Assignee: Lisa Monahan Metal Works, Newton Highlands, MA (US)

( * ) Notice: Subject to any disclaimer, the term of this patent is extended or adjusted under 35 U.S.C. 154(b) by 1181 days.

(21) Appl. No.: 12/152,857

(22) Filed: May 16, 2008

(65) Prior Publication Data

US 2009/0282867 A1 Nov. 19, 2009

(51) Int. Cl.
*A44C 7/00* (2006.01)
*A44C 13/00* (2006.01)
*A44C 15/00* (2006.01)

(52) U.S. Cl.
CPC ..... *A44C 7/002* (2013.01); *A44C 13/00* (2013.01); *A44C 15/005* (2013.01)
USPC ..... 63/40; 63/12; 63/13

(58) Field of Classification Search
USPC ..... 63/12, 13, 40, 14.1, 1.16; D11/40, 41, D11/43
See application file for complete search history.

(56) References Cited

U.S. PATENT DOCUMENTS

| | | | | | |
|---|---|---|---|---|---|
| 10,921 | A | * | 5/1854 | Higgins | 63/13 |
| 122,328 | A | * | 1/1872 | Northup | 63/13 |
| 169,940 | A | * | 11/1875 | Alden | 63/13 |
| 1,561,128 | A | * | 11/1925 | Waller | 63/12 |
| D138,956 | S | * | 10/1944 | Karples | D11/75 |
| D161,526 | S | * | 1/1951 | Philippe | D11/43 |
| 2,739,596 | A | * | 3/1956 | Roberts | 606/188 |
| 2,797,561 | A | * | 7/1957 | Vaughn | 63/13 |
| D208,263 | S | * | 8/1967 | Mariani | D11/43 |
| 3,345,830 | A | * | 10/1967 | Fontaine | 63/13 |
| 3,605,438 | A | * | 9/1971 | Chalson | 63/20 |
| D236,224 | S | * | 8/1975 | Hardison | D11/43 |
| 4,022,318 | A | * | 5/1977 | Goodman | 206/223 |
| 4,057,980 | A | * | 11/1977 | DeCesaris | 63/13 |
| 4,086,786 | A | * | 5/1978 | Ritter | 63/13 |
| D248,380 | S | * | 7/1978 | Burchett | D11/43 |
| D256,003 | S | * | 7/1980 | Barr | D11/43 |
| 4,353,225 | A | * | 10/1982 | Rogers | 63/13 |
| 4,753,828 | A | | 6/1988 | Francis et al. | |
| 4,781,036 | A | | 11/1988 | Erickson | |
| 4,803,852 | A | * | 2/1989 | Waldron | 63/13 |
| 4,869,078 | A | * | 9/1989 | Leith et al. | 63/13 |
| D308,348 | S | * | 6/1990 | Leopoldi | D11/43 |
| 5,161,390 | A | * | 11/1992 | Sam | 63/12 |
| D339,310 | S | * | 9/1993 | Azrielant | D11/40 |

(Continued)

OTHER PUBLICATIONS

Boston Globe's Daily Shopping Tip for Friday, Feb. 2, 2007, "Ready to Wear Hardware".

(Continued)

*Primary Examiner* — Emily Morgan
(74) *Attorney, Agent, or Firm* — Hamilton, Brook, Smith & Reynolds, P.C.

(57) ABSTRACT

Described is an interchangeable earring kit, an interchangeable necklace kit, a combination interchangeable earring and necklace kit and a system of add-on decorative elements for all of the kits. These kits can be used to create a jewelry wardrobe from interchangeable parts. The kits exist as single or combination systems for do-it-yourself jewelry design wear. The kits are contained in compartmentalized boxes to allow for separation of the components.

10 Claims, 3 Drawing Sheets

(56) References Cited

U.S. PATENT DOCUMENTS

| | | | | | |
|---|---|---|---|---|---|
| D348,023 | S | * | 6/1994 | Horner et al. | D11/43 |
| D368,050 | S | * | 3/1996 | Hayslip | D11/44 |
| D388,011 | S | * | 12/1997 | Leonard | D11/40 |
| D406,544 | S | * | 3/1999 | Leonard | D11/40 |
| D410,589 | S | * | 6/1999 | Lagergren | D11/40 |
| 5,927,104 | A | | 7/1999 | Green | |
| 6,079,224 | A | * | 6/2000 | Schehr | 63/12 |
| D542,696 | S | * | 5/2007 | Cilluffo | D11/40 |
| 7,222,503 | B2 | * | 5/2007 | Golove | 63/33 |
| 2005/0247079 | A1 | * | 11/2005 | Padeh | 63/13 |
| 2008/0289363 | A1 | * | 11/2008 | Langford | 63/1.16 |

OTHER PUBLICATIONS

Boston Globe Feature Article for Jun. 4, 2006, "Objets d'art from hardware".

The Middlesex Beat article, "Chain, Chain, Chain: Metalwork by Lisa Monahan", Jun. 2006.

* cited by examiner

INTERCHANGEABLE EARRING AND NECKLACE KITS AND METHODS FOR THEIR STORAGE AND USE

BACKGROUND OF THE INVENTION

Earrings and necklaces are typically provided to the user as finished products giving the user minimal choice as to how to wear the accessory. There have been some attempts at user modifiable jewelry. Golove (U.S. Pat. No. 7,222,503) provides a ring with a removable and changeable stone. Erickson (U.S. Pat. No. 4,781,036) describes an earring in which one can unscrew a front and replace it with other designs that screw on. Francis (U.S. Pat. No. 4,753,828) describes a similar earring with a removable backing that one can paint on a desired image. Green (U.S. Pat. No. 5,927,104) describes again an earring with fronts that are unscrewed to replace with other designed fronts. These inventions are difficult to use and limited in the variety that one can obtain. They are also not organized.

SUMMARY OF THE INVENTION

Described is an interchangeable earring kit, an interchangeable necklace kit and a combination interchangeable earring and necklace kit. These kits are used to create a jewelry wardrobe from a number of interchangeable parts. The kits exist as single or combination systems for do-it-yourself jewelry design wear. The kits are contained and organized within compartmentalized boxes to allow for separation of and easy identification of the components.

In one embodiment, an earring kit is described. The earring kit includes a pair of closed loop earrings, plural pairs of accessories interchangeably carried by the earrings individually or in combination, and a container having compartments containing respective pairs of closed loop earrings and pairs of accessories.

The opening width of each earring can be about 10 mm. The closed loop earrings can be leverback earrings, hoop earrings or huggies. The kit can include accessories such as plain metal loops, plastic loops, loops have designs thereon, and drop chains.

Also described is a method of creating earring combinations including the steps of providing a container containing a pair of closed earrings and plural pairs of accessories interchangeably carried by the closed earrings individually or in combination, selecting pairs of accessories from the container and positioning the accessories on the closed earrings to create earring combinations for wear, and removing the pairs of accessories from the closed earrings and positioning different pairs of accessories from the container on the closed earrings to create alternative earring combinations for wear.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
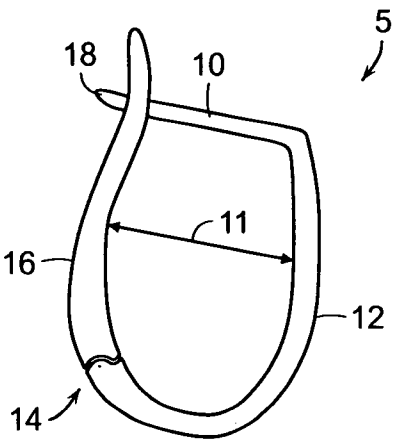
FIG. 1 is a plan view of a closed loop earring.

The earring kit includes at least one pair of closed loop earrings, accessories and an organizational box. The preferred earring is a closed loop earring. The use of closed loop earrings simplifies the ability of the user to add decorative components to create unique styles. It does not require any additional hardware to hold the accessories in place. FIG. 1 is an illustration of one example of a closed loop earring 5 which consists of ear post 10, decorative front 12, hinge 14, lever back 16 and locking clasp 18. Other closed loop earrings such as huggies and hoops may be used such that one or more accessories can hang from the hoop and may include pierced and non-pierced earring styles. Other shapes of closed earrings can also be used, such as squares, triangles and other suitably shaped, closed earrings. These earrings may be made from silver with a polished or oxidized finish, gold, gold vermeil, platinum, base metal, copper or other materials commonly used in earring construction. An opening width 11 of the earring should be about 5-15 mm in diameter and preferably about 10 mm in diameter to make it easy for the user to place accessories onto the earring and for the accessory to hang easily from the earring.

Figure 2:
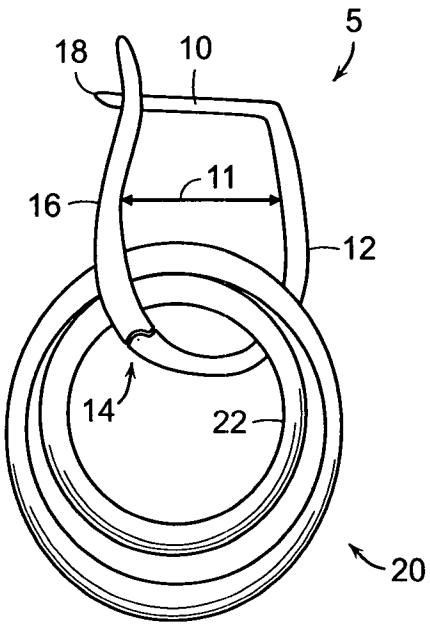
FIG. 2 is a plan view of a single earring with accessories.

Accessories are added to the closed loop earrings by the user as shown in the embodiment of FIG. 2. Closed loop earring 5 is shown with two accessories 20 and 22 hanging from within. These accessories may include a closed element to engage the earring. Examples of these accessories may include gold, platinum, copper and silver rings, donut shaped semi-precious stones, nitrile O-rings, silicone rubber O-rings, metal (gold or silver) chain, perforated metal or plastic, shells, stones, fruit and vegetable shells with holes or perforations or any other suitable accessory.

The user is able to place whichever accessory they wish onto the closed loop earring, thereby customizing the desired look. To do so, the user opens the closed loop earring, for example by pulling back on lever 16. The user is then able to place one or more accessories onto the earring 5, hanging it from the front loop 12. In this example, the user may then put the earring post 10 into their ear and close lever 16 to lock it in place. The user may place any number of accessories onto the earring as desired.

Figure 3:
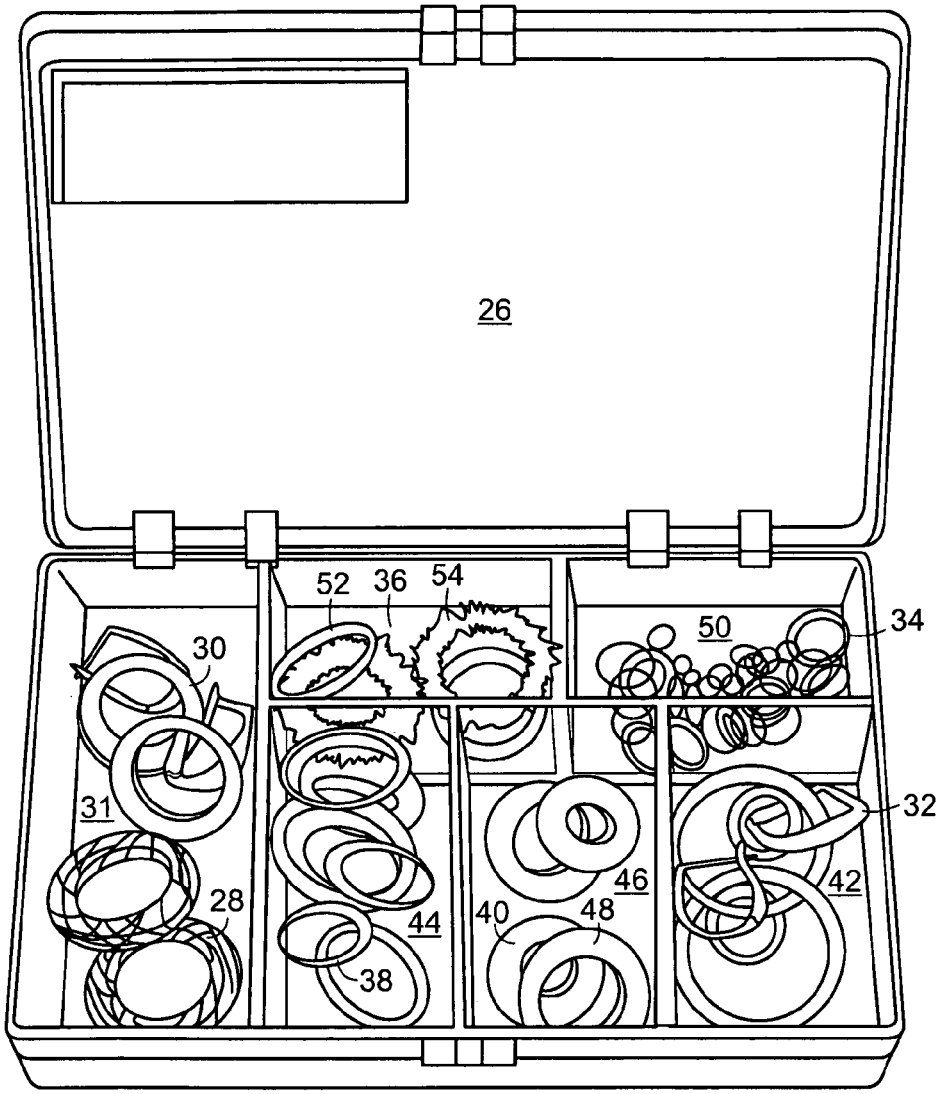
FIG. 3 is a perspective view of an earring kit.

A preferred embodiment of the interchangeable earring kit 24 is shown in FIG. 3. Components are neatly assembled in compartment box 26 which in this case has 6 compartments. This kit is comprised of one pair of sterling silver closed loop earrings, brightly polished, pre-assembled with 2 black O-rings on each 32 in one compartment 42. An additional pair of oxidized silver earrings pre-assembled with brushed silver washers 30 are in compartment 31. Also in compartment 31 are copper hoops 28. In compartment 44 are placed a number of multi-colored silicone bands 38. Also placed in the bottom of compartment 44 are a number of anti-tarnish paper strips (charcoal paper, 3M). These keep the silver components from tarnishing during storage. In compartment 46 are placed a pair of anodized aluminum hoops 40 and a pair of nylon hoops 48. In compartment 50 are placed two pairs of silver chains 34. In compartment 36 are a pair of silicone O-rings 52 and a pair of nickel-plated brass hoops 54. Other suitable combinations of the components in the kit are also possible.

Figure 4:
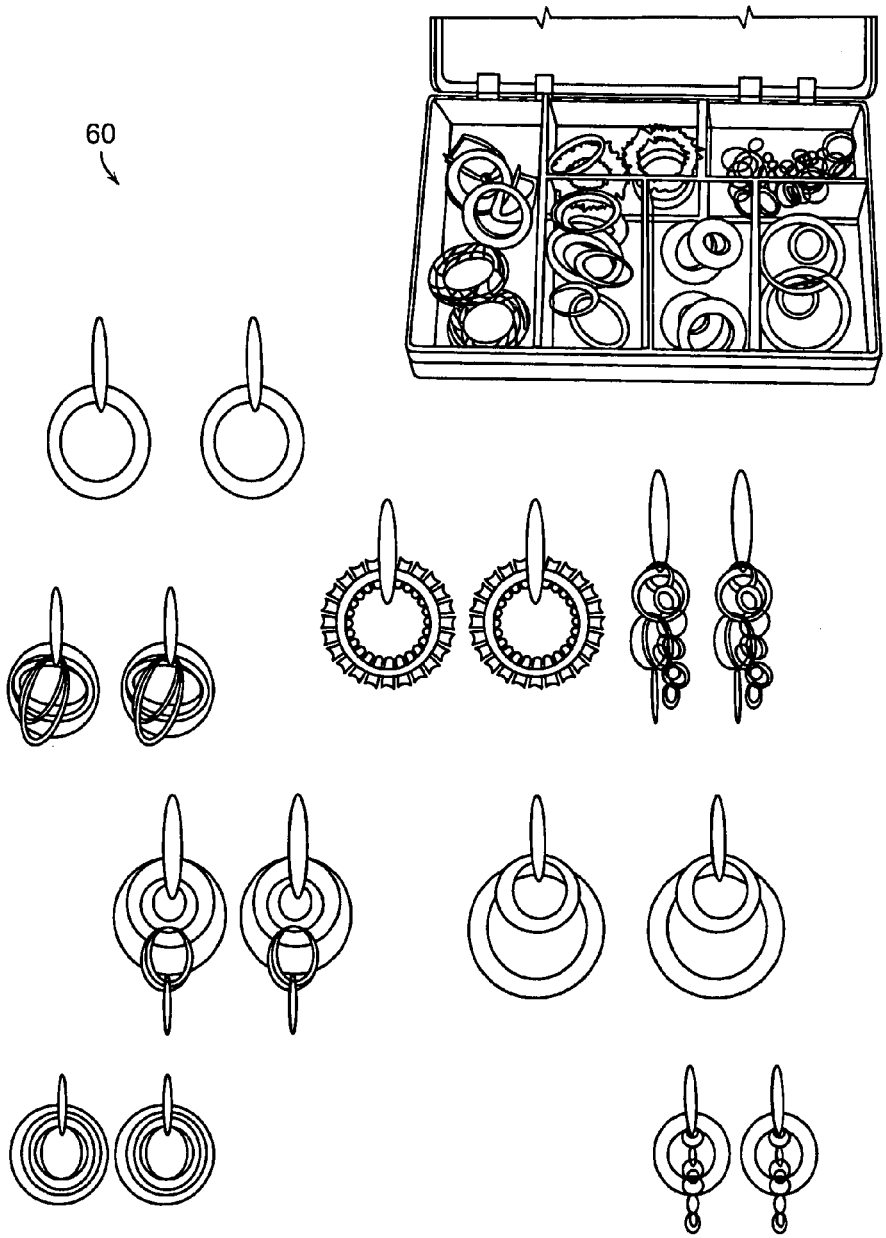
FIG. 4 is a representation of labeling showing combination options for the kit.

Also included in the kit is a pictorial representation, label, showing the user various assembly options. One embodiment of a label 60 is shown in FIG. 4. Other types of labels can also be included.

The box 26 may contain more or less number of compartments depending on the size of the kit, but most likely contains at least two compartments. The box may be hinged and may have a clasp to hold it shut especially for travel. It may be made of plastic, wood or metal or any other suitable material.

Other kits may be constructed to consist of similar accessories, but with necklaces instead of closed loop earrings. The necklaces are opened by the user, the accessories are added and the necklace is closed around the user's neck. In this way, the user customizes the necklace in a fashion similar to the earring.

Kits may also be made with both earring and necklace combinations. The kit may include the basic earring kit as described above, but with an additional selection of necklaces that can be used singularly or in combination. The necklaces can be adorned with the accessories.

Earrings, necklaces and accessories may also be supplied separately to supplement ones' existing kit.

Kits may be customized to appeal to distinct markets. The preferred embodiment described above is a basic kit. A higher quality kit may contain earrings and/or necklaces and accessories made of silver, gold, gold vermeil and/or platinum and semi-precious stones. Earrings may be embellished with diamonds or other precious stones. Accessories may be made of gold, gold vermeil, platinum and semi-precious stones among other items. The box may be made of wood and/or metal and glass components with velvet liners. Other kits may be assembled with mixtures of high and low-end earring, necklace, bracelet and accessory materials. Sport team accessories may be added to kits showing sport team emblems and colors.

What is claimed is:

1. An earring kit comprising:

a pair of closed loop earrings, each earring having an earring loop configured to open and close to receive accessories and to attach to an ear with the earring loop passing through the ear, the earring loop having an opening with a width in the range of about 5 mm to 15 mm;

plural pairs of accessories, including drop chains and varied pairs of decorative loops, interchangeably carried by the closed loop earrings, individually or in combination, the decorative loops passing through the openings of and resting on the earring loops of the closed loop earrings and being decorative elements that do not support further decorative elements; and a container having compartments respectively containing the pair of closed loop earrings and pairs of accessories.

2. A kit as claimed in claim 1, wherein the earring loops are about 10 mm in opening width.

3. A kit as claimed in claim 1, wherein the closed loop earrings are lever back earrings.

4. A kit as claimed in claim 1, wherein the pairs of accessories include plain loops and loops having designs thereon.

5. A kit as claimed in claim 1, further comprising plural pairs of closed loop earrings.

6. A method of creating earring combinations comprising:

providing a container containing a pair of closed loop earrings, each earring having an earring loop configured to open and close to receive accessories and to attach to an ear with the loop passing through the ear, the earring loop having an opening with a width in the range of about 5 mm to 15 mm, and plural pairs of accessories, including drop chains and varied pairs of decorative loops, interchangeably carried by the closed loop earrings, individually or in combination;

selecting pairs of accessories from the container and positioning the accessories, with the decorative loops passing through the openings of and resting on the earring loops of the closed loop earrings and not supporting further decorative elements, to create earring combinations for wear; and removing the pairs of accessories from the closed loop earrings and positioning different pairs of accessories from the container on the closed loop earrings to create alternative earring combinations for wear.

7. A method as claimed in claim 6, wherein the earring loops are about 10 mm in opening width.

8. A method as claimed in claim 6, wherein the closed loop earrings are lever back earrings.

9. A method as claimed in claim 6, wherein the pairs of accessories include plain loops and loops having designs thereon.

10. A method as claimed in claim 6, wherein the container contains plural pairs of closed loop earrings.

* * * * *